US006484768B2

(12) United States Patent
Puranen et al.

(10) Patent No.: US 6,484,768 B2
(45) Date of Patent: Nov. 26, 2002

(54) KNIFE ASSEMBLY FOR VENEER LATHE

(75) Inventors: Jussi Puranen, Lahti (FI); Seppo Vartiainen, Villähde (FI); Jarkko Hyttinen, Espoo (FI)

(73) Assignee: Raute Oyj, Nastola (FI)

( * ) Notice: Subject to any disclaimer, the term of this patent is extended or adjusted under 35 U.S.C. 154(b) by 0 days.

(21) Appl. No.: 09/987,032

(22) Filed: Nov. 13, 2001

(65) Prior Publication Data

US 2002/0056489 A1 May 16, 2002

(30) Foreign Application Priority Data

Nov. 13, 2000 (FI) ..... 20002479

(51) Int. Cl.[7] ..... B27L 5/02

(52) U.S. Cl. ..... 144/213; 144/209.1; 144/356; 144/364; 144/365; 700/167

(58) Field of Search ..... 700/167; 144/209.1, 144/211, 212, 213, 356, 357, 365, 364

(56) References Cited

U.S. PATENT DOCUMENTS

| | | | | |
|---|---|---|---|---|
| 3,581,844 A | | 6/1971 | Carlton | |
| 4,222,421 A | | 9/1980 | Walser et al. | |
| 4,893,663 A | | 1/1990 | Ely | |
| 5,967,208 A | * | 10/1999 | Calvert | 144/209.1 |

OTHER PUBLICATIONS

A.O. Fiehl, Reducing Heat Distortion in the Knife and Pressure Bar Assemblies of Veneer Lathes, Ottawa Laboratory Forest Products Laboratories of Canada, Jul. 1958, pp. 216–218.*

* cited by examiner

*Primary Examiner*—W. Donald Bray
(74) *Attorney, Agent, or Firm*—Connolly Bove Lodge & Hutz, LLP; Larry J. Hume

(57) ABSTRACT

The invention relates to a veneer lathe knife assembly comprising supported by a frame assembly a knife mounting beam (4) and a nose bar beam (5), both of which having a front portion (4'; 5') for holding a cutting knife (6) and a nose bar (7), respectively, and a stiffening rear portion. The knife mounting beam (4) and the nose bar beam (5) are adapted movable relative to each other on the frame assembly so as to permit adjustment of the knife gap formed between the cutting knife (6) and the nose bar (7). Heat transfer means (2, 2', 2", 2''') are adapted to the stiffening rear portion of both the knife mounting beam (4) and the nose bar beam (5). Both the knife mounting beam (4) and the nose bar beam (5) have placed thereon, in a close vicinity to the knife (6) and the nose bar (7), at least one first set of temperature sensors (3, 3') disposed in predetermined positions along the length of the knife and the nose bar. Furthermore, both the knife mounting beam (4) and the nose bar beam (5) have placed thereon, at a distance from the knife (6) and the nose bar (7), at least one second set of temperature sensors (1, 1', 1", 1''') disposed in predetermined positions along the length of the knife and the nose bar, whereby the heat transfer means (2, 2', 2''', 2") placed in the stiffening rear portion (4", 4'''; 5", 5''') of both the knife mounting beam (4) and the nose bar beam (5) are adapted controllable for adjusting the respective portions of the knife mounting beam and the nose bar beam under feedback from the second set of temperature sensors to a temperature value derived from the measurement signal given by the first set of temperature sensors.

7 Claims, 1 Drawing Sheet

KNIFE ASSEMBLY FOR VENEER LATHE

BACKGROUND OF THE INVENTION

The invention relates to a knife assembly for a veneer lathe. Conventionally, the knife assembly includes a knife mounting beam and a nose bar beam, both supported by a frame structure. Either one of these elements comprises a beam-like member which extends essentially over the entire length of the lathe and incorporates means required for mounting the opposed blade elements known as the cutting knife and the nose bar. Generally, the opposed sides of the support beam are provided at the fixing points of the blade elements with a plurality of bulkhead-like projecting members that function as stiffeners of the support beam structure. The knife assembly is arranged controllably movable along guides toward the log being peeled in synchronism with the progress of peeling, and, respectively, away therefrom when the peeling of a new log is to be started. The mutual distance between the knife mounting beam and the nose bar beam is made adjustable to control the knife gap between these opposed knife elements. To achieve a good peeling result, it is mandatory to keep the knife gap in a predetermined value over the entire length of the knife mounting beam and the nose bar beam. Hence, accurate control of the knife gap requires both the knife mounting beam and the nose bar beam to be massive structures that are rigid and resistant to bending.

Conventionally, veneer is peeled from soaked wood that has been kept in a water or steam bath in order to elevate the temperature of the log. When entering the lathe station, the temperature of the log may by as high as 80° C. Additional heat is generated from the friction of the knife peeling the log and the nose bar running on the log, as well as from the friction of the veneer passing through the knife gap. This heat load is imposed on the knife mounting beam and the nose bar beam within the structures of the beams holding the knife bar and the nose bar. Such a local rise of temperature generates thermal stresses in the knife mounting beam and the nose bar beam that result in minor deformations of these structures. However, the deformations also are reflected in the value of the knife gap that should stay constant to a tolerance of about 0.02 mm over the entire length of the knife and nose bar.

In the prior art a remedy to this problem has been generally sought by way of providing heating means on the rear portions of the knife mounting beam and the nose bar beam that are on the opposite side of the beam relative to the mounting structures of knife and nose bar. Conventionally, such heating has been accomplished by adapting cavities into the reinforcing structures of the rear portions of the beams and then circulating heated medium therein. The goal of these arrangements has been to stabilize the temperature of the entire knife/nose bar assembly at an elevated level. This technique can indeed minimize deformations induced by thermal stresses on the knife mounting beam and the nose bar beam. However, the overall result thus obtained has not been sufficiently well controlled to keep the knife gap at its predetermined value over the entire length of the knife.

SUMMARY OF THE INVENTION

A knife assembly, which is implemented according to the invention and comprises in a conventional manner a frame assembly that supports a knife mounting beam and a nose bar beam, both of which having a front portion for holding a cutting knife and a nose bar insert, respectively, and a stiffening rear portion, whereby the knife mounting beam and the nose bar beam are adapted movable relative to each other on the frame assembly so as to permit adjustment of the knife gap formed between them, and further comprises heat transfer means adapted to the stiffening rear portion of both the knife mounting beam and the nose bar beam, offers in accordance with the invention an improvement in controlling the knife gap to a correct predetermined value by virtue of having placed on both the knife mounting beam and the nose bar beam, in a close vicinity to the knife and nose bar at least one first set of temperature sensors disposed in predetermined positions along the length of the knife and nose bar, and, both the knife mounting beam and the nose bar beam having placed thereon at least one second set of temperature sensors, disposed in predetermined positions along the length of the knife and nose bar, at a distance from the knife and the nose bar, and the assembly further having the heat transfer means located in the stiffening rear portion of the knife mounting beam and the nose bar beam, respectively, being adapted controllable for adjusting the respective portions of the knife mounting beam and the nose bar beam under feedback from the second set of temperature sensors to a temperature value derived from the measurement signal given by the first set of temperature sensors.

Next, the invention will be examined in greater detail with the help of the attached drawing, wherein is diagrammatically illustrated a knife assembly of a veneer lathe.

BRIEF DESCRIPTION OF THE DRAWING

Referring to the diagram, therein is shown a knife assembly having a conventional construction comprising a knife mounting beam 4 and a knife 6 fixed thereto for peeling veneer from a log supported and rotated by spindles (not shown) in a manner known per se. To above the knife mounting beam is adapted a nose bar beam 5 having a nose bar 7 mounted thereon. The knife mounting beam and the nose bar beam are supported at their ends to a frame structure in a manner known per se, whereby the frame forms a portion of the veneer lathe knife system known as knife assembly in the art. The working length, i.e. the distance between the spindles of a veneer lathe, which is the maximum length of a log that can be peeled, is standardized so that the lathe is adapted to peel veneer from logs of a standard length only. While lathes designed for 8 ft logs are most common, also widely used are lathes made for 4 ft. logs. Lathes are limited by constructional problems to a maximum length of about 10 ft., that is, to peeling logs less than 4 m long.

DESCRIPTION OF PREFERRED EMBODIMENTS

Figure 1:
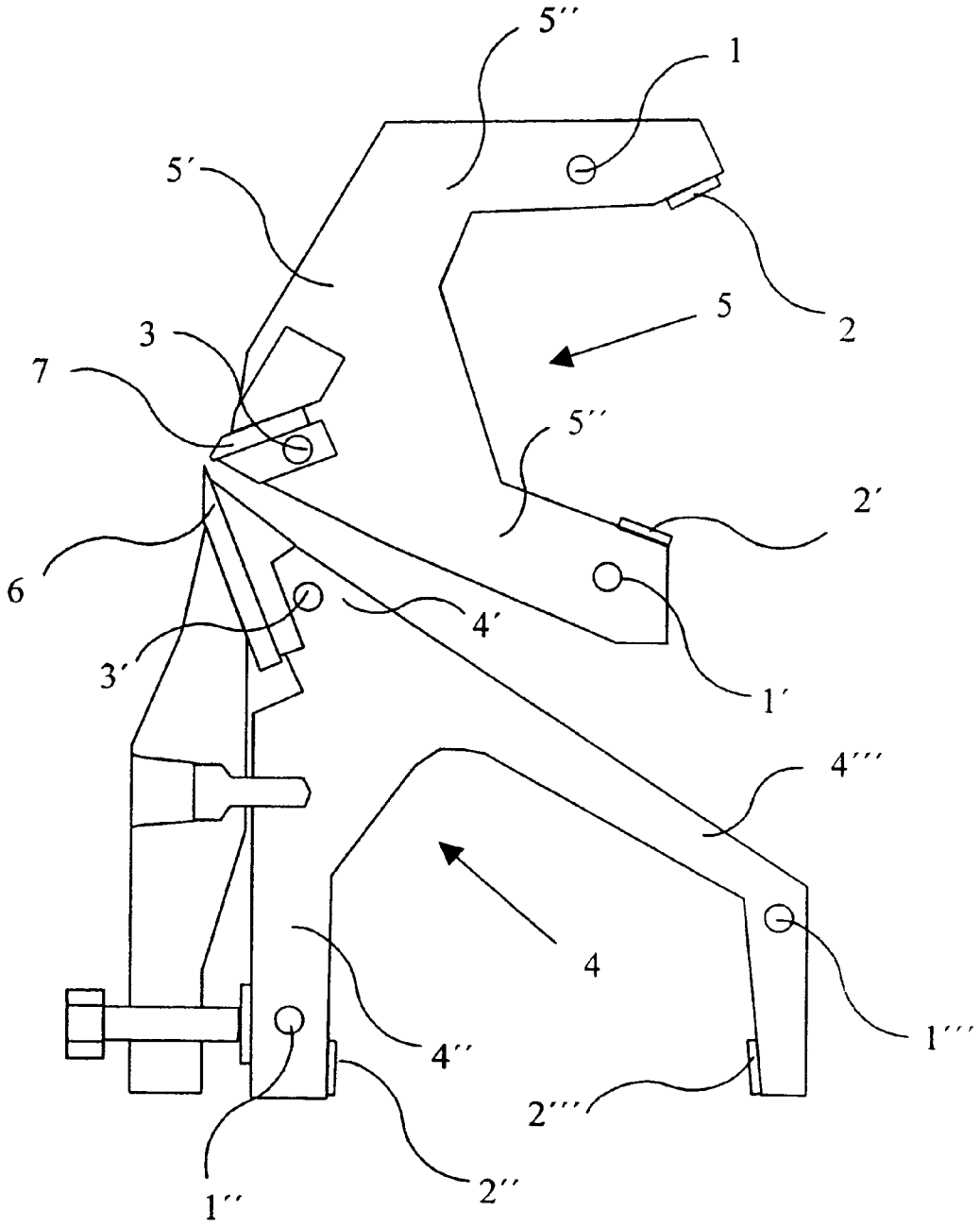

The illustrated lathe construction incorporates a plurality of temperature sensors disposed so that the front portion 4', respectively 5' of the knife mounting beam and the nose bar beam carries a first set of temperature sensors 3, 3' close to the knife 6 and nose bar 7, respectively. The sensor signals thus obtainable give information on temperatures in the region of the knife and nose bar during peeling. From such data it is possible by computational or empirical means to estimate the temperatures to which certain ones of the primarily stiffening elements 4", 4'" and 5", 5'" located at a distance from the knife and the nose bar in the rear portion of the knife mounting beam 4 and the nose bar beam 5, respectively, should be taken in order to avoid causing in knife mounting beam and the nose bar beam such thermal differentials that tend to cause detrimental deformations in these knife assembly members. The knife mounting beam and nose bar beam also have adapted thereto a second set of temperature sensors 1, 1' and 1", 1'", respectively, at areas whose temperatures are intended to be controlled to values obtained by estimation or computation on the basis of the temperature information obtained from the first set of sensors. The temperature adjustment is carried out with the help of heat transfer means 2, 2', 2", 2'". The second set of temperature sensors 1, 1', 1", 1'" serves to control the operation of the heat transfer means.

Generally, the heat transfer means 2, 2', 2", 2'" are heatable elements capable of elevating the temperature of the structures in the rear portions of the knife mounting beam 4 and the nose bar beam 5 closer to the temperature values sensed close to the knife and nose bar. Depending on the type of structures used in the knife mounting beam and the nose bar beam, the second set of temperature sensors 1, 1', 1", 1'", may also be driven by the control system toward such set values of temperature that are more remote from those measured by the first temperature sensors 3 and 3', whereby even negative temperature differentials are possible, thus urging the reinforcing structures in the rear portions of the knife mounting beam 4 and the nose bar beam 5 to be cooled.

Advantageously, the temperature sensors of the first set 3 and 3', as well as the temperature sensors of the second set 1, 1', 1", 1'", are placed equidistantly spaced from each other along the entire length of the lathe. Similarly, the heat transfer means 2, 2', 2", 2'" are distributed along the entire length of the lathe thus permitting the control of the temperature profile of the lathe along its entire length. If the heat transfer means are implemented using discrete elements disposed at a distance from each other along the length of the lathe, also a local control of the temperature profile is possible.

What is claimed is:

1. A veneer lathe knife assembly supported by a frame assembly, comprising:

a knife mounting beam and a nose bar beam, both of which having a front portion which hold a cutting knife and a nose bar, respectively, and a stiffening rear portion, said knife mounting beam and said nose bar beam being movable relative to each other on the frame assembly, wherein adjustment of the knife gap formed between the cutting knife and the nose bar is accomplished by the relative movement between said knife mounting beam and said nose bar beam;

heat transfer means arranged in to the stiffening rear portion of both the knife mounting beam and the nose bar, wherein both the knife mounting beam and the nose bar beam have placed thereon, in a close vicinity to the cutting knife and the nose bar, at least one first set of temperature sensors disposed in first predetermined positions along a length of the cutting knife and the nose bar, wherein both the knife mounting beam and the nose bar beam have placed thereon, at a distance from the knife and nose bar, at least one second set of tempeature sensors disposed in second predeted positions along the length of the cutting knife and the nose bar, wherein the heat tansfer means include temperature adjusting means for adjusting a temperature of respective portions of the knife mounting beam and the nose bar beam, using feedback from the at least one second set of temperature sensors, to a temperature value derived from a measurement signal provided by the at least one first set of temperature sensors.

2. The knife assembly according to claim 1, wherein said heat transfer means include heating elements.

3. The knife assembly according to claim 1, wherein said heat transfer means include cooling elements.

4. The knife assembly according to claim 1, wherein a number of said at least one first temperature sensors are located at a distance from each other, essentially over an entire length of said knife and said nose bar.

5. The knife assembly according to claim 1, wherein a number of said at least one second set of temperature sensors are located at a distance from each other essentially over an entire length of said knife mounting beam and said nose bar beam.

6. The knife assembly according to claim 1, wherein said heat transfer means are located at a distance from each other, essentially over an entire length of said knife mounting beam and said nose bar beam.

7. The knife assembly according to claim 1, wherein said knife assembly includes means for detecting the knife gap and for generating a correction factor in a control system of said heat transfer means.

* * * * *